US007699308B2

(12) United States Patent
Häusler et al.

(10) Patent No.: US 7,699,308 B2
(45) Date of Patent: Apr. 20, 2010

(54) APPARATUS FOR DIVERTING SHEET MATERIAL

(75) Inventors: August Häusler, Wolfratshausen (DE); Ralf Linck, München (DE); Markus Sperl, Garching (DE)

(73) Assignee: Giesecke & Devrient GmbH, München (DE)

( * ) Notice: Subject to any disclaimer, the term of this patent is extended or adjusted under 35 U.S.C. 154(b) by 0 days.

(21) Appl. No.: 12/087,574

(22) PCT Filed: Jan. 9, 2007

(86) PCT No.: PCT/EP2007/000126

§ 371 (c)(1),
(2), (4) Date: Oct. 3, 2008

(87) PCT Pub. No.: WO2007/080100

PCT Pub. Date: Jul. 19, 2007

(65) Prior Publication Data

US 2009/0174136 A1 Jul. 9, 2009

(30) Foreign Application Priority Data

Jan. 10, 2006 (DE) ..... 10 2006 001 231

(51) Int. Cl.
*B65H 29/00* (2006.01)

(52) U.S. Cl. ..... 271/186; 271/185; 271/225

(58) Field of Classification Search ..... 271/225, 271/184, 185, 186
See application file for complete search history.

(56) References Cited

U.S. PATENT DOCUMENTS 5,333,851 A 8/1994 Kulpa
5,362,039 A * 11/1994 Kusters ..... 271/225

(Continued)

FOREIGN PATENT DOCUMENTS

DE 41 22 214 A1 1/1993

(Continued)

OTHER PUBLICATIONS

Search Report of German Patent Office regarding German Patent Application No. 10 2006 001 231 3, Sep. 12, 2006.

*Primary Examiner*—Patrick H Mackey
*Assistant Examiner*—Gerald W McClain
(74) *Attorney, Agent, or Firm*—Bacon & Thomas, PLLC.

(57) ABSTRACT

An apparatus for diverting sheet material, in particular bank notes (BN), includes a diverting plate (4) with a first diverting edge (7) disposed on a slant and preferably a second diverting edge (8) disposed on a slant. The sheet material is guided and transported from the rear side (6) of the diverting plate (4) around the first diverting edge (7) to the front side (5) and further around the second diverting edge (8) back to the rear side (6). If the diverting edges (7, 8) are aligned relative to the transport direction (1, 2, 3) of the sheet material e.g. in each case at a slant angle of 45°, this apparatus permits the sheet-material transport direction to be diverted by 180°, whereby the transport path is shifted parallel. Thus, a continuous bank-note stream can be diverted uninterruptedly while retaining the sheet-material orientation relative to the transport direction. By means of a gate (12) the sheet material can be guided to a downstream diverting edge (13) instead of to the second diverting edge (8).

19 Claims, 5 Drawing Sheets

U.S. PATENT DOCUMENTS

| | | | | |
|---|---|---|---|---|
| 5,538,240 | A * | 7/1996 | Auerbach et al. | 271/225 |
| 6,098,978 | A | 8/2000 | Bielefeld et al. | |
| 6,227,532 | B1 | 5/2001 | Bakoledis | |
| 2005/0029168 | A1 | 2/2005 | Jones et al. | |

FOREIGN PATENT DOCUMENTS

| | | | |
|---|---|---|---|
| DE | 196 32 224 | A1 | 2/1998 |
| GB | 323576 | | 1/1930 |
| JP | 59167446 | | 9/1984 |
| JP | 61150950 | | 7/1986 |
| WO | WO 97/33823 | | 9/1997 |
| WO | WO 2006/133936 | A1 | 12/2006 |

* cited by examiner

APPARATUS FOR DIVERTING SHEET MATERIAL

BACKGROUND

A. Field

This invention relates to an apparatus for diverting flat, rectangular sheet material, in particular sheet-shaped value documents such as bank notes, from a first sheet-material transport path with a first transport direction to a sheet-material transport path with a transport direction different from the first transport direction, in particular for changing the transport direction by 90° or by 180°. The invention relates further to an apparatus for processing sheet-shaped value documents, in particular bank notes, with such a diverting apparatus between a first and a further transport path with different transport directions.

B. Related Art

Diverting apparatuses in which sheet material is diverted e.g. by 90° or 180° are used for example in bank-note processing apparatuses. Conventional diverting apparatuses, however, are either unsuitable for diverting an uninterrupted bank-note stream in such a way at high throughput speed, or are at least comparatively troublesome with regard to space requirements and/or their structural layout.

US-2005/0029168 A1 discloses for example a multimodular bank-note processing apparatus in which the diverting apparatus according to the invention described hereinafter can also be used advantageously. Said bank-note processing apparatus is configured as a tabletop device and serves to single the bank notes of a bank-note stack inserted into an input pocket by an operator, to check the singled bank notes with regard to characteristic features by means of suitable measuring and analysis devices, to sort the checked bank notes according to the particular check result, and to stack them in a predetermined output pocket by means of a spiral slot stacker depending on the sorting result. The output pockets are disposed partly side by side and partly one above the other such that all output pockets are optimally reachable by the operator. The bank notes are transported fundamentally in transverse orientation within the modules.

A disadvantage of said bank-note processing apparatus is that a very voluminous transport path formed from guide plates and twisted transport belts is provided for rotating the bank notes so that they can be transported further in transverse orientation laterally to the adjacent modules. The bank notes are thereby first rotated by 90° around their transport axis by means of the twisted transport belts, then the bank notes are diverted by 90° around an axis perpendicular to the transport direction and transferred in this orientation to the adjacent module. There the bank notes are returned to their original orientation by being first diverted by 90° again and then rotated around the transport axis by 90° by means of the twisted transport belts again. This method for transferring the bank notes from one module to an adjacent module while retaining the sheet-material orientation relative to the transport direction is very troublesome with regard to space requirements and structural layout, but does permit at least an uninterrupted bank-note stream to be diverted at high throughput speed.

WO97/33823 discloses an apparatus for changing the transport direction of single sheets as could presumably be used in the bank-note processing apparatus known from US-2005/0029168 A1 for diverting the bank notes by 90° to the adjacent modules. Bank notes transported in transverse orientation would then be passed on after the 90° diversion in longitudinal orientation to the adjacent module and could be diverted there by 90° accordingly again, so that they could then be processed further in transverse orientation again. However, this apparatus has the disadvantage that the diverting area must first be cleared before the next following bank note can run into the diverting area in order to avoid a collision of the leading bank note with the following one. It is therefore not possible with this apparatus to divert an uninterrupted bank-note stream at high throughput speed.

DE 196 32 224 A1 also describes an apparatus for diverting sheet material. It is proposed therein to do without diverting rollers in the diverting area and instead extend transport belts of the feeding and removing transport paths beyond the diverting zone in each case such that the bank note is removed from the diverting zone by means of the transport belt of the removing transport path. By means of a lever and roller system the transport belt of the removing transport path is pressed against the removal plane of the diverting area whenever a bank note has been fed to the removal plane. To increase the throughput while avoiding the previously described risk of collision of consecutive bank notes, a special embodiment provides for feeding the consecutive bank notes alternatingly to a first or a second removal plane by means of a gate, so that the next following sheet can already be fed to the second removal plane before the preceding sheet has been completely removed from the first removal plane and passed on. This accordingly requires two removal systems, one for each removal plane. This does permit an uninterrupted bank-note stream to be diverted at high throughput speed. However, providing a plurality of removal systems requires high constructional effort.

It is therefore the object of the present invention to propose an apparatus for diverting sheet material, such as bank notes or other sheet-shaped value documents, between a first and a further sheet-material transport path with different transport directions that permits an uninterrupted bank-note stream at high throughput speed while involving relatively little constructional effort.

SUMMARY OF THE INVENTION

The inventive diverting apparatus is characterized by, among other things, the fact that the sheet-material orientation relative to the transport direction does not change upon diversion of the sheet material. Instead, sheet material fed from the first transport path in transverse orientation is diverted in said orientation and passed on to the subsequent transport path. This is done by means of a stationary guide body with a first transport plane whose sheet material yet to be diverted is feedable in a first transport direction, and a second transport plane parallel to the first transport plane for passing on already diverted sheet material in a direction different from the first transport direction. The two transport planes are connected via a straight diverting edge for transporting the sheet material from the first to the second transport plane. The diverting edge is disposed on a slant to the transport direction, the slant angle of the diverting edge being identical relative to the feeding transport direction and relative to the removing transport direction. Thus, if the removing transport direction deviates from the feeding transport direction by an angle $\alpha 1$, the slant angle $\beta 1$ enclosed between the diverting edge and the two transport directions is $\alpha 1/2$ in each case. Obviously, the diverting apparatus also comprises a transport device for transporting the sheet material along at least single ones of the transport planes in the respective transport direction.

The sheet material transported and diverted in this way does not change its orientation upon diversion. Only the transport direction changes, and of course the transport plane from a first transport plane to a second transport plane parallel thereto. The distance between the two transport planes depends on the width of the diverting edge and can be kept small.

Such an apparatus can be of very simple constructional design, in particular if the guide body is configured as a diverting plate with a rear side constituting the first transport plane and a front side constituting the second transport plane.

A diversion by 90° is achievable by means of such a diverting apparatus if the slant angle $\beta_1$ of the diverting edge is 45°. The 90° diverting apparatus can advantageously be disposed at an interface between two processing modules of the above-described bank-note processing apparatus, e.g. in vertical alignment on the rear side of the module, to guide sheet material from one module to an adjacent module.

The second transport plane preferably has, in addition to the previously described first straight diverting edge, a second straight diverting edge for redirecting the already diverted sheet material again in a third transport direction which is located in a third transport plane parallel to the second transport plane. Just as the first diverting edge is disposed on a slant at an identical angle to the first and second transport directions, the second diverting edge is aligned at an identical angle $\beta_2$ on a slant to the second and third transport directions. Said slant angle $\alpha_2$ is again half as large as an angle $\alpha_2$, where $\alpha_2$ designates the angle by which the third transport direction deviates from the second transport direction.

Due to the double diversion, the third transport direction can be located in the same transport plane as the first transport direction. It is particularly preferable in this case to again configure the guide body as a diverting plate, since here the rear side of the diverting plate constitutes the first and third transport planes and the front side constitutes the second transport plane for the sheet material.

Depending on the choice of the slant angles $\beta_1$ and $\beta_2$ it is possible to adjust a total diversion angle $\beta_2$ which is twice as great as the sum of the slant angles $\beta_1$ and $\beta_2$. A total diversion by 90° is thus achievable while retaining the transport plane if the slant angles $\beta_1$ and $\beta_2$ are 45° in total. A total diversion $\beta$ of 180° results, in contrast, if the slant angles $\beta_1$ and $\beta_2$ are 90° in total. In the latter case the feeding transport direction is thus opposite to the removal transport direction and located parallel thereto. Such a 180° diverting apparatus can be used for example as an interface-bridging element between two bank-note processing modules, for example in vertical alignment across modules on the rear sides of the modules.

A particularly preferred development of this diverting apparatus with two diverting edges comprises a gate for alternatively supplying the sheet material diverted on the first diverting edge to the second diverting edge. In the inactive state the sheet material is transported across the gate along the second transport direction, so that only one diversion takes place on the first diverting edge by for example 90°. In the active state, in contrast, the gate supplies the sheet material to the second diverting edge and a second diversion is effected for example again by 90°, so that a total diversion either by 90° or by 180° is adjustable by means of the gate.

For this purpose, the second transport plane has two overlapping portions in an area downstream of the gate, a first portion of which leads to the second diverting edge. The sheet material is thus transported over said first portion when the gate is active. When the gate is inactive, in contrast, the sheet material is transported further over the gate and the second portion without a change of transport direction.

However, the sheet material transported further over the gate can also be diverted over a third straight diverting edge at the end of the first transport plane in a similar manner as described above with respect to the second diverting edge. Preferably, the slant angle $\beta_3$ of the third diverting edge is in this case identical to the slant angle $\beta_2$ of the second diverting edge, so that the transport direction of sheet material diverted around the second and third diverting edges is identical but shifted parallel.

This permits the sheet material transported along a transport path to be divided up over two transport paths which can preferably be disposed parallel to each other and in particular parallel to the first transport path and which are located in a common transport plane if the widths of the diverting edges are selected to be identical.

Accordingly, the second transport plane can be prolonged further in the direction of the second transport direction and have additional gates and diverting edges to permit further transport paths to be operated in accordance with the number of gates or diverting edges. Such an apparatus with one transport path for sheet-material feed and two or more, preferably parallel, transport paths for sheet-material removal is particularly suitable for the above-described sheet-material processing apparatus having a plurality of output pockets disposed side by side.

Accordingly, it is also possible to prolong the second transport plane contrary to the second transport direction and to integrate further "first" diverting edges for supplying sheet material from a plurality of "first" transport paths to the second transport plane. The same effect also already results when operating the previously described apparatus with one feeding transport path and a plurality of removing transport paths in the reverse transport direction.

Hitherto, substantially only the guide body of the diverting apparatus has been described. The diverting apparatus expediently furthermore comprises a transport device for actively transporting the sheet material along at least single transport planes. It is preferable to use such a transport device that holds the sheet material in contact with the transport planes during transport, in particular pressing it against the transport planes. It is then possible to omit transport means integrated in the guide body or diverting plate.

For example, the sheet material can be moved along the single transport planes by means of one or more transport belts and/or transport rollers. It is expedient here to use a transport belt for transporting the sheet material along the second transport plane and around at least one diverting edge, that is, for example, around the first diverting edge or the last diverting edge. The transport belt then performs a guidance function for the sheet material to be diverted in the area of the diverting edge too, so that reliable sheet-material guidance is ensured, on the one hand, and there is no need for separate guiding elements in the area of the diverting edge, on the other hand.

It is particularly expedient if the sheet material is transportable by means of the transport belt both around the first diverting edge and around the last diverting edge, that is, around the second, third or a further diverting edge. For all diverting edges located therebetween around which the sheet material is diverted upon a corresponding gate position, the guiding element necessary in the area of the diverting edge in question can be realized as an integral part of the guide body or diverting plate. The sheet material diverted on said diverting edges and exiting at the rear side of the guide body can be transported further from there by means of a separate transport belt or by means of transport rollers.

DESCRIPTION OF THE DRAWINGS

The invention will hereinafter be explained more precisely by way of example with reference to the accompanying drawings. Therein are shown.

DETAILED DESCRIPTION OF PREFERRED EMBODIMENTS OF THE INVENTION

Figure 1:
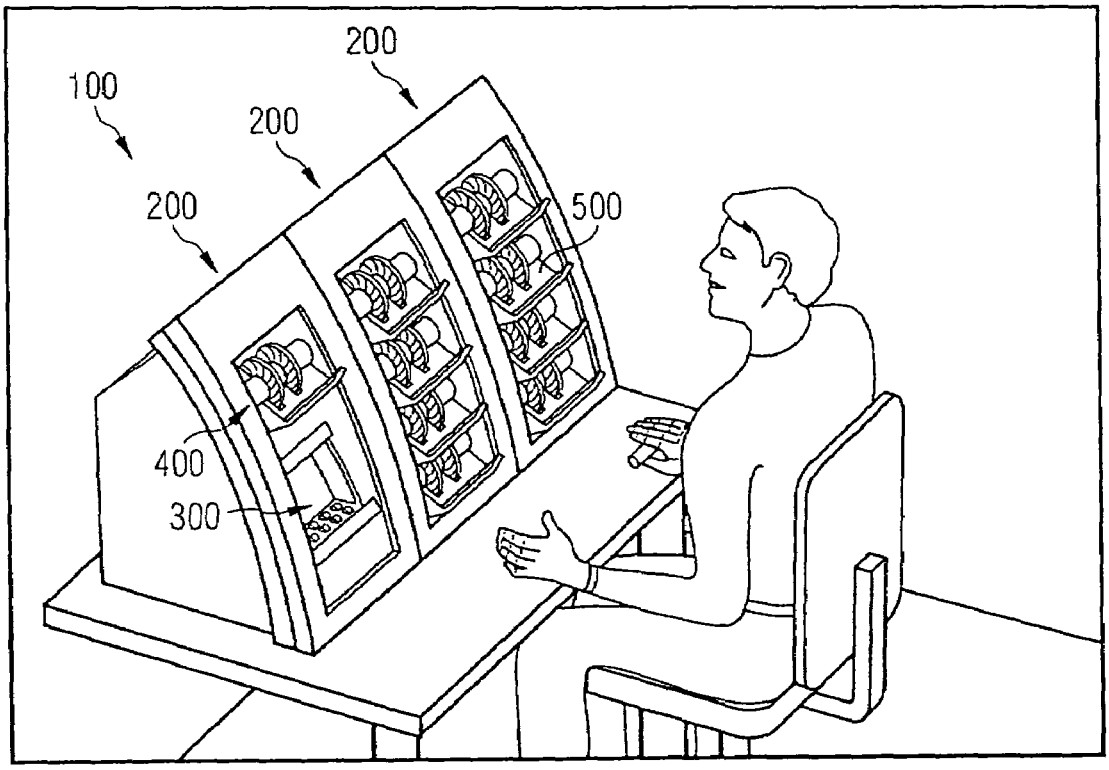
FIG. 1 a multimodular bank-note processing apparatus as a desktop model.

FIG. 1 shows a bank-note processing apparatus 100 as a concrete example of an apparatus for processing sheet-shaped value documents. The apparatus is of modular construction and comprises three modules 200 in the shown exemplary embodiment. The left module comprises a sheet-material singler 300 with an input pocket into which an operator can insert a bank-note stack or other value documents, such as checks. The bank notes are drawn singly into the left module 200 by means of the singler 300 and checked and sorted by means of devices contained therein for measuring and checking sheet-material properties. This check can for example confine itself to the denomination of the inputted bank notes. Additionally or instead, it is also possible to check the quality and/or authenticity features of the bank notes. Bank notes that do not fulfill certain check criteria, because e.g. the denomination is not determinable and/or the result of the authentication check was negative and/or the fitness for circulation is no longer given, are outputted as so-called "rejects" in the reject pocket 400 disposed above the singler 300. The other documents are fed to a predetermined output pocket 500 in accordance with the check result, so that they can be taken out of the output pockets 500 in appropriately sorted form by the operator.

In the shown exemplary embodiment, the two right modules 200 serve only to output the bank notes. Devices for measuring and checking the bank notes need not, but can, be contained here. All output pockets 400, 500 are executed as spiral slot stackers in the shown exemplary embodiment.

The bank notes are inputted, processed and outputted in transverse format in the bank-note processing apparatus 100. For transporting the bank notes from one module 200 to the next module 200 it is advantageous to use a diverting apparatus as described hereinafter with reference to FIGS. 2A to 4B. Such a diverting apparatus can be provided for example in the area of the rear side of a module 200 in vertical alignment in such a way that the bank notes BN transported in transverse format are fed to the diverting apparatus vertically from above and passed on in a removal direction B located at 90° thereto while retaining the transverse orientation. Such an arrangement is particularly space-saving. In the next module 200 the bank note can then optionally be diverted by 90° again by means of the diverting apparatus. The diverting apparatus can also cause a 180° diversion in bridging fashion between two or more modules 200.

Figure 2A:
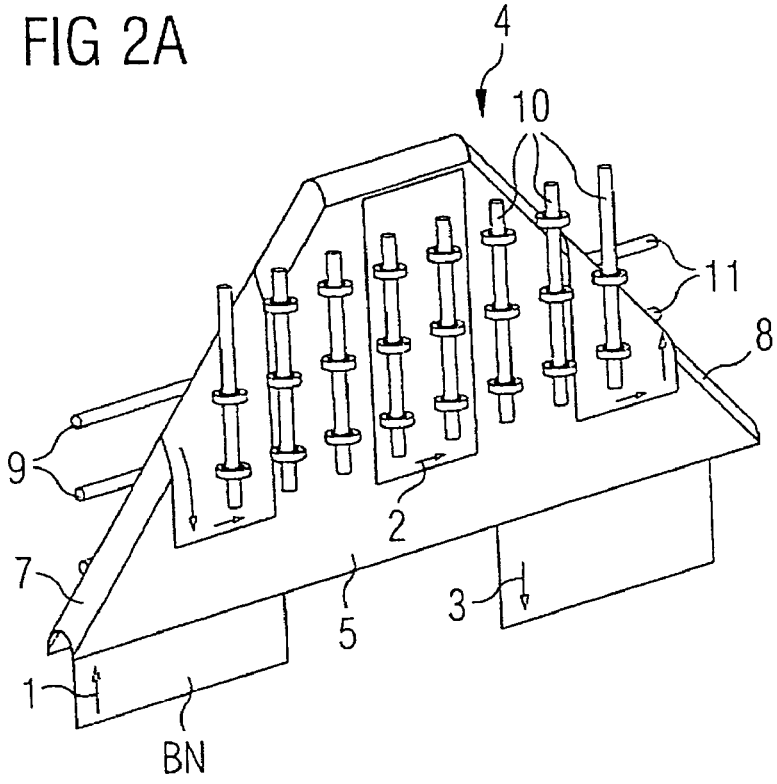
FIG. 2A a schematic perspective front view of an inventive diverting apparatus, FIG. 2B a perspective rear view of the diverting apparatus from FIG. 2A, FIG. 3A a perspective front view of a development of the diverting apparatus from FIGS. 2A and 2B, FIG. 3B a perspective rear view of the diverting apparatus from FIG. 3A, FIG. 3C the diverting apparatus in the representation according to FIG. 3A but with a changed gate position, FIG. 3D a rear view for the representation in FIG. 3C, FIG. 4A an exploded view of a bipartite diverting plate of the apparatus from FIGS. 3A to 3D as a perspective front view, and FIG. 4B the exploded view according to FIG. 4A as a perspective rear view.
Figure 2B:
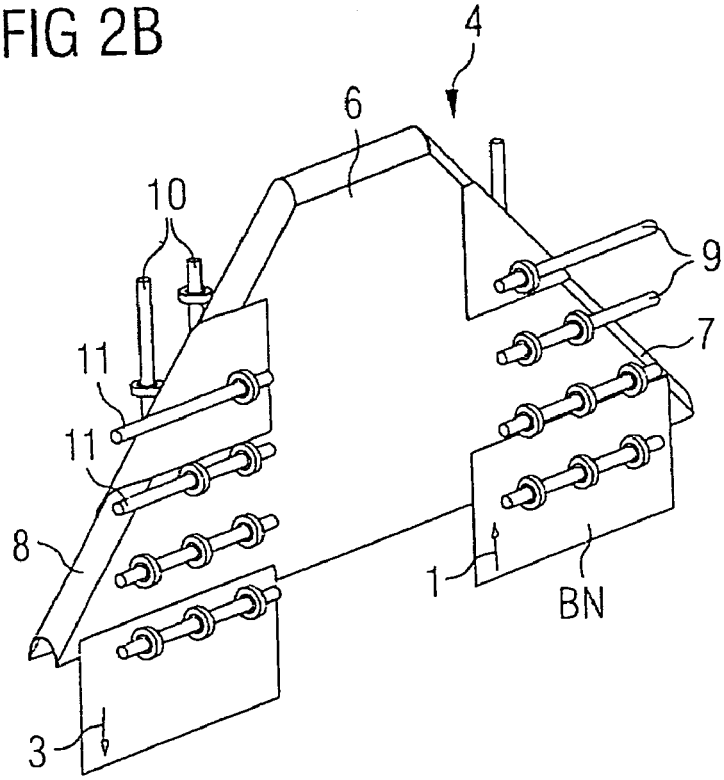

FIG. 2A shows schematically a perspective front view of an inventive diverting apparatus according to a first exemplary embodiment. FIG. 2B shows the same apparatus in perspective from the rear side. This diverting apparatus serves to divert bank notes BN while retaining their orientation (here: transverse orientation) from a first transport direction 1 by 90° to a second transport direction 2 and to divert them by 90° again to a transport direction 3 parallel to the first transport direction 1. For this purpose, the bank notes BN are guided over a diverting plate 4 whose front side 5 and rear side 6 constitute transport planes over which the bank notes BN are transported. The diverting edges 7 and 8 of diverting plate 4 are straight and are oriented on a slant with regard to the transport directions 1, 2 or 2, 3. The slant angle is 45° in all cases here, so that when the bank notes BN are transported over the rear transport plane 6 and around the first straight diverting edge 7 to the front transport plane 5 they are diverted by 90° while retaining their transverse orientation. At the same time the bank notes are turned over. Upon further transport from the front transport plane 5 over the second straight diverting edge 8 back to the rear transport plane 6 there is again a 90° diversion with a simultaneous bank-note turnover. The third transport direction 3 in which the bank notes BN are transported further by the diverting apparatus is then located parallel to, and in the same transport plane 6 as, the feeding first transport direction 1.

If only one 90° diversion is desired, the second diverting edge 8 can be omitted. However, if e.g. a 90° diversion is desired by which the transport plane of the passed-on sheet material matches the transport plane 6 of the fed sheet material, it is possible to use the diverting apparatus from FIGS. 2A, 2B with two straight diverting edges which have a smaller slant angle relative to the transport directions. The slant angles of the two diverting edges 7, 8 should then add up to 45° in total (instead of the 90° in FIGS. 2A, 28). At a slant angle of 22.5° in each case the second transport direction 2 would be inclined by 45° relative to the first transport direction 1, and the third transport direction 3 likewise by 45° relative to the second transport direction 2, resulting in a diversion of 90° in total while retaining the sheet-material transport plane and sheet-material orientation.

In FIGS. 2A and 2B the transport means provided are roller assemblies 9, 10, 11 for transporting the bank notes BN in the direction of the transport directions 1, 2, 3 along the transport planes 5, 6 of the diverting plate 4 and simultaneously pressing them against the transport planes 5, 6. For clarity's sake, FIGS. 2A and 2B omit guiding elements in the area of the diverting edges 7, 8 which ensure that the bank notes BN are guided from the first transport device 9 around the first diverting edge 7 to the second transport device 10 and from the second transport device 10 around the second diverting edge 8 to the third transport device 11.

The roller assembly 10 and either the roller assembly 9 or the roller assembly 11, but preferably all three roller assemblies 9 to 11, can also be replaced by a transport belt. It is then possible to omit guiding elements in the area of the diverting edges 8, 9 since this function is performed by such a transport belt which is guided around the diverting edges 8 and/or 9.

Figure 3A:
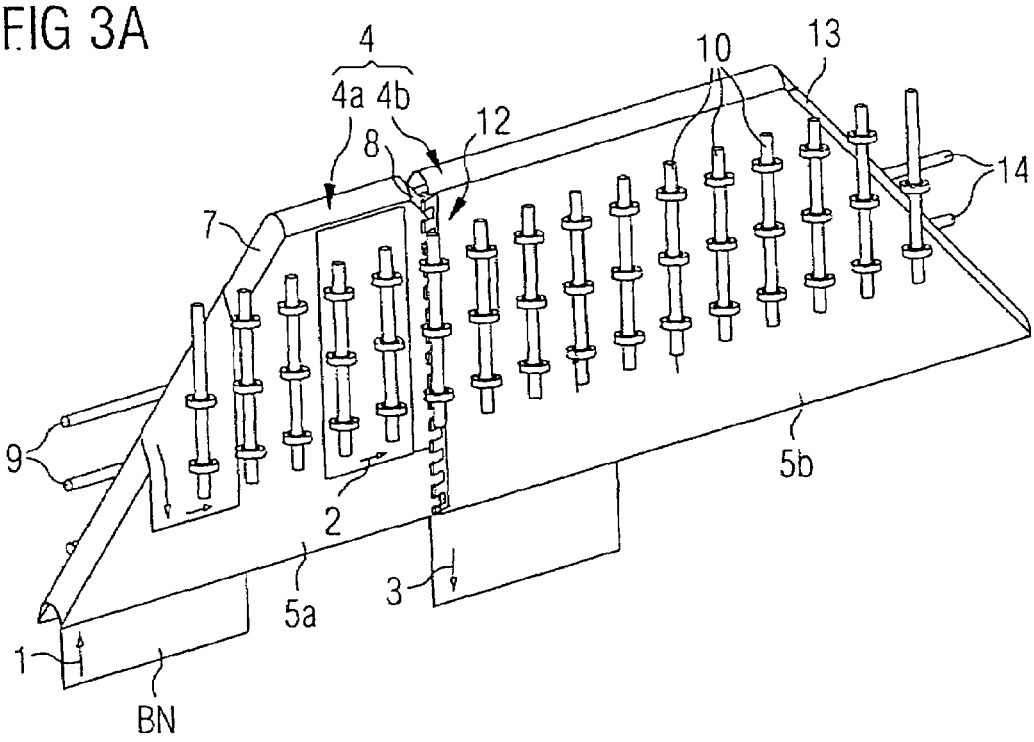
Figure 3B:
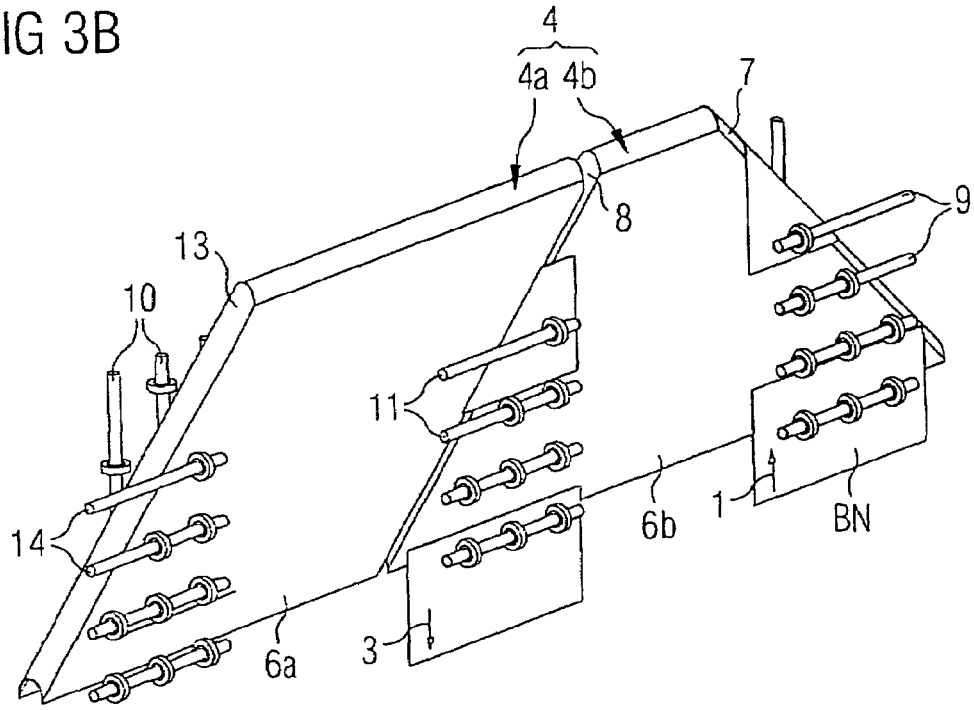

FIGS. 3A and 3B show a development of the diverting apparatus from FIGS. 2A, 2B again schematically as perspective front and rear views. The diverting plate 4 is configured longer here, whereby it comprises two parts 4*a*, 4*b* which overlap each other. In the shown exemplary embodiment, the first part 4*a* of the diverting plate 4 at the front in the transport direction can in principle be configured identically to the diverting plate 4 described with respect to FIGS. 2A, 2B. Only the second part 4*b* of the diverting plate 4 that is downstream in the transport direction is joined thereto and partly overlaps with its front transport plane 5*b* the front transport plane 5*a* of the front part 4*a* of the diverting plate 4. A gate 12, which is an integral part of the rear transport plane 5*b* here, can be swiveled between an active and an inactive position for supplying the bank notes BN either under the transport plane 5*b* of the rear diverting plate part 4*b* through to the second diverting edge 8, or over said transport plane 5*b* to a third diverting edge 13.

In FIGS. 3A, 3B the gate 12 is active. "Active" designates in this connection a gate position such that the bank notes BN are supplied to the next diverting edge, here the diverting edge 8. Accordingly the bank notes to be diverted are diverted by means of the roller assemblies 9, 10, 11 around the diverting edges 7, 8 along the transport paths 1 to 3 in the same manner as explained previously with respect to FIGS. 2A, 2B. The gate is always disposed perpendicular here and not on a slant to the transport direction 2, since a slanted arrangement would lead to a jam of the bank notes BN to be diverted or those following on the gate 12.

Figure 3C:
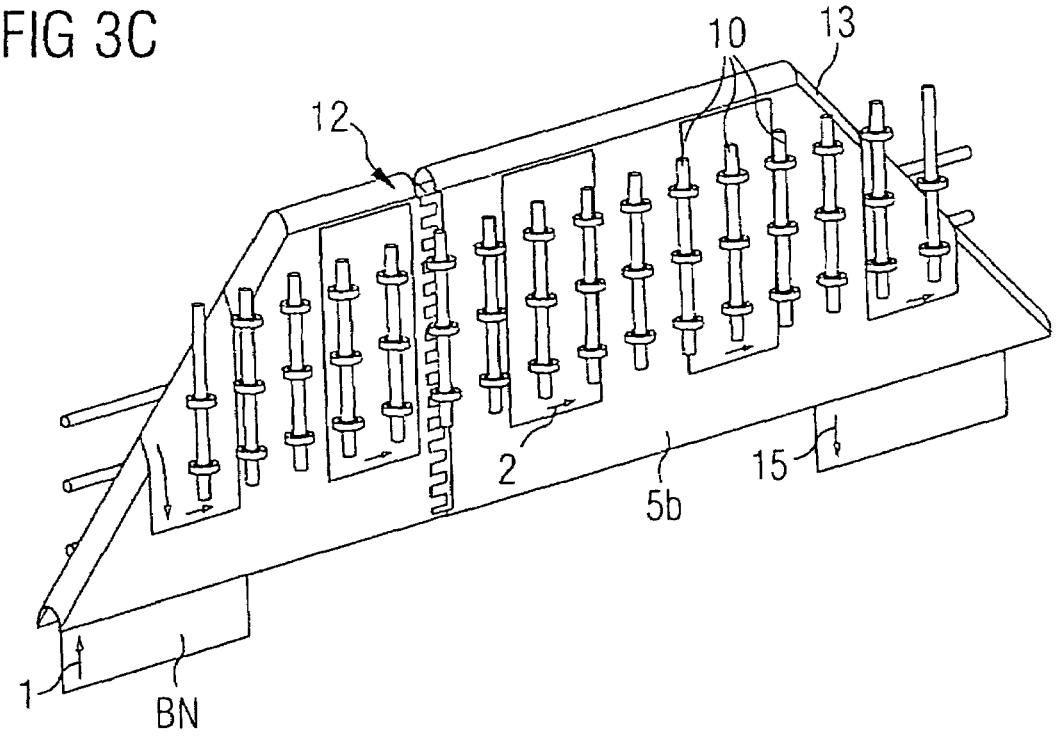
Figure 3D:
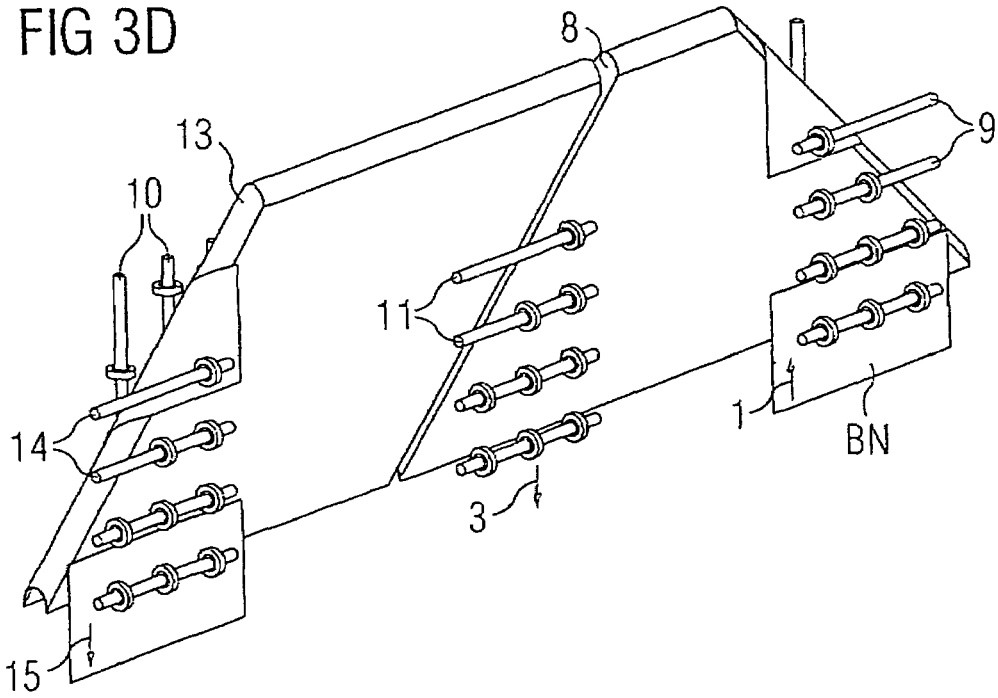

FIGS. 3C, 3D show the apparatus from FIGS. 3A, 3B with the gate 12 switched inactive. Accordingly, the bank notes BN are transported by means of the second roller assembly 10 across the gate 12 along the front transport plane 5*b* of the rear diverting plate part 4*b* to the third straight diverting edge 13, diverted therearound and transported further by means of a fourth roller assembly 14 in a fourth transport direction 15. The slant angle of the third diverting edge 13 relative to the transport direction 2 is identical to the slant angle of the second diverting edge 8, so that the fourth transport direction 15 accordingly extends shifted parallel to the third trans-port direction 3.

It is also possible in this exemplary embodiment according to FIGS. 3A to 3D to replace the roller assemblies 9, 10, 14 by a continuous transport belt. The roller assembly 11 acting on the rear transport plane 6*b* of the rear diverting plate part 4*b* can likewise be replaced by a (separate) transport belt.

Figure 4A:
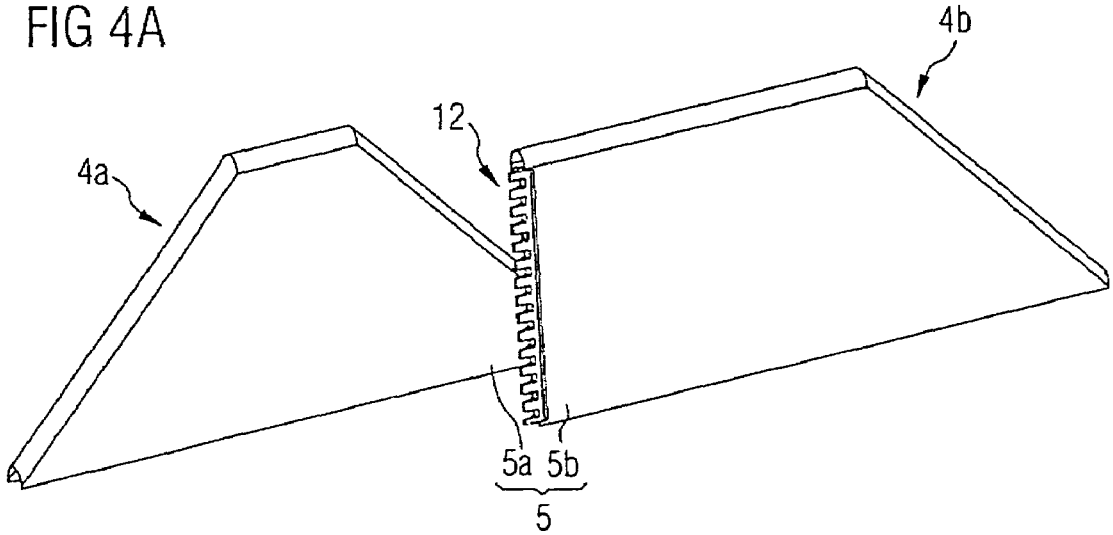
Figure 4B:
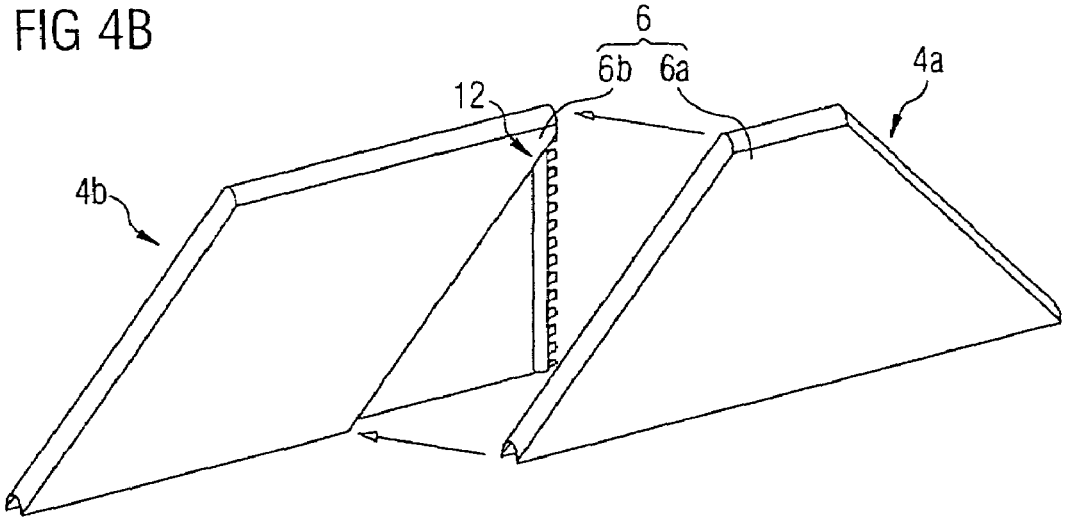

FIGS. 4A, 4B show the two parts 4*a*, 4*b* of the bipartite diverting plate 4 in the manner of an exploded view in perspective from the front and in perspective from behind. This is a schematic representation which shows how the transport plane 5*b* of the part 4*b* of the diverting plate 4 that is downstream in the transport direction covers the transport plane 5*a* of the first part 4*a* of the diverting plate 4, so that the sheet material can be guided either over or under the transport plane 5*b* of the rear diverting plate part 4*b* by suitable switching of the gate 12.

The invention claimed is:

1. An apparatus for diverting flat, rectangular sheet material, comprising a stationary guide body defining a first transport plane arranged to guide sheet material yet to be diverted along a first transport direction, and a second transport plane extending parallel to the first transport plane arranged to guide already diverted sheet material along a second transport direction different from the first transport direction by a first angle $\alpha_1$, a straight diverting edge connecting the first transport plane and the second transport plane arranged to divert sheet material from the first transport plane to the second transport plane, the diverting edge being disposed on a slant at a second angle $\beta_1=\alpha_1/2$ relative to both the first transport direction and the second transport direction, and a transport device arranged to transport the sheet material along at least single ones of the transport planes in a respective transport direction;

wherein the second transport plane has adjoining it a second straight diverting edge for further diverting the already diverted sheet material to a third transport direction different from the second transport direction by a third angle $\alpha_2$, the second diverting edge being disposed on a slant at a fourth angle $\beta_2=\alpha_2/2$ relative to both the second transport direction and the third transport direction.

2. The apparatus according to claim 1, wherein the guide body is configured as a diverting plate with a rear side constituting the first transport plane and a front side constituting the second transport plane.

3. The apparatus according to claim 1, wherein the second angle $\beta_1$ is equal to 45°.

4. The apparatus according to claim 1, wherein the third transport direction is located in the first transport plane.

5. The apparatus according to claim 1, wherein the sum of the first and third angles $\alpha_1$ and $\alpha_2$ is 90° in total, such that the third transport direction is opposite to the first transport direction.

6. The apparatus according to claim 1, including a gate arranged to alternatively supply the already diverted sheet material to the second diverting edge.

7. The apparatus according to claim 6, wherein the second transport plane includes two overlapping portions downstream of the gate in the transport direction, a first portion of which leads to the second diverting edge.

8. The apparatus according to claim 6, wherein the second transport plane has at least one third straight diverting edge downstream of the gate in the transport direction arranged to divert the already diverted sheet material to a further transport direction which is different from the second transport direction by a fifth angle $\alpha_3$, the at least one third diverting edge being disposed on a slant at a sixth angle $\beta_3=\alpha_3/2$ relative to both the second transport direction and the further transport direction.

9. The apparatus according to claim 8, wherein the sixth angle $\beta_3$ is equal to the fourth angle $\beta_2$.

10. The apparatus according to claim 1, wherein the transport device is adapted to hold the sheet material in contact with the transport planes during transport.

11. The apparatus according to claim 10, wherein the transport device comprises a transport belt by means of which the sheet material is transportable along the second transport plane and around at least one diverting edge.

12. The apparatus according to claim 11, including a guide arrangement arranged to guide the belt around the first diverting edge and second diverting edge.

13. The apparatus according to claim 11, wherein the guide arrangement is configured so as to guide the belt around the first diverting edge and third diverting edge.

14. The apparatus according to claim 1, wherein the transport device comprises one or more transport roller assemblies.

15. An apparatus for processing sheet-shaped value documents, comprising a first sheet-material transport path and a second sheet-material transport path, and a diverting apparatus according to claim 1 arranged to divert sheet material at least from the first to the second transport path.

16. The apparatus according to claim 15, wherein the transport planes of the diverting apparatus are inclined at an angle to the horizontal.

17. The apparatus according to claim 16, wherein the transport planes are aligned vertically.

18. The apparatus according to claim 15, including one or more devices arranged to measure and check properties of the sheet material as well as at least one sheet-material input pocket with a sheet-material singler and at least one sheet-material output pocket.

19. The apparatus according to claim 15, including a plurality of apparatus modules, and wherein the diverting apparatus is disposed between the first and second sheet-material transport paths at a handover point where sheet material is transported from one apparatus module to another apparatus module.

* * * * *